US006732552B2

(12) United States Patent
Kim et al.

(10) Patent No.: US 6,732,552 B2
(45) Date of Patent: May 11, 2004

(54) DRAWER-TYPE WASHING MACHINE AND LOCKING METHOD THEREOF

(75) Inventors: Hyoun Jin Kim, Seoul (KR); Dong Won Kim, Kwangmyung-si (KR); Young Hwan Park, Kwangmyung-si (KR); Yong Chul Kim, Seongnam-si (KR); Byung Keol Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 274 days.

(21) Appl. No.: 09/895,154

(22) Filed: Jul. 2, 2001

(65) Prior Publication Data

US 2002/0056293 A1 May 16, 2002

(30) Foreign Application Priority Data

Nov. 13, 2000 (KR) ..... 2000-67224
Dec. 15, 2000 (KR) ..... 2000-77250

(51) Int. Cl.[7] ..... D06F 1/00; D06F 39/14

(52) U.S. Cl. ..... 68/12.26; 68/27; 134/57 DL; 312/228; 312/270.3

(58) Field of Search ..... 134/56 D, 56 R, 134/57 D, 57 R, 58 D, 58 R; 312/198, 215, 222, 228, 270.3; 68/12.26, 12.27, 27, 210

(56) References Cited

U.S. PATENT DOCUMENTS 2,570,529 A * 10/1951 Dolan ..... 68/20
4,426,794 A * 1/1984 Vanderheijden ..... 34/109
5,438,766 A * 8/1995 Nakamura ..... 34/602
5,470,142 A * 11/1995 Sargeant et al. ..... 312/258
6,189,551 B1 * 2/2001 Sargeant et al. ..... 134/200
6,260,565 B1 * 7/2001 Welch et al. ..... 134/200
6,571,808 B2 * 6/2003 Todd ..... 134/58 D
6,588,238 B1 * 7/2003 Reason ..... 68/24

* cited by examiner

*Primary Examiner*—Frankie L. Stinson
*Assistant Examiner*—Joseph L Perrin
(74) *Attorney, Agent, or Firm*—Birch, Stewart, Kolasch & Birch, LLP

(57) ABSTRACT

The present invention relates to a drawer-type washing machine and a locking method thereof. The washing machine includes a housing having one open side and partitioned into a plurality of compartments; cabinets which can be drawn out forward through the open side of the housing, each of the cabinets being positioned in each of the compartments; washing baths for washing the laundry, each of the washing baths being positioned within each of the cabinets; and locking mechanism provided between the housing and the cabinets for restraining the cabinet from being drawn out forward from the housing. The cabinets are automatically drawn out by only operating a switch installed in an outside wall of the housing.

13 Claims, 7 Drawing Sheets

DRAWER-TYPE WASHING MACHINE AND LOCKING METHOD THEREOF

BACKGROUND OF THE INVENTION

1. Field of the Invention

The present invention relates to a drawer-type washing machine and a locking method thereof. The drawer-type washing machine comprises a housing having one open side and is partitioned into a plurality of compartments, cabinets positioned within the compartments and washing baths positioned within the cabinets, in which the cabinets are automatically drawn out by only operating a switch installed in an outside wall of the housing. It is prevented that the washing machine falls down as all of the cabinets are drawn out biasing the center of gravity forward.

2. Description of the Related Art

FIG. 1 is a longitudinal sectional view of an upright washing machine of the related art.

In the upright washing machine of the related art, a housing 104 defines a contour of the washing machine and has a cover 102 mounted to the upper surface of the housing 104 and switchable between open and closed positions, a washing bath 106 and 108 has an outer bath of tub 106 installed within the housing 104 for containing washing water and an inner bath or basket 108 installed within the tub 106 for doubling as a washing basket and a dryer basket, a driving unit 110 is installed under the tub 106 for rotating the basket 108, and a damper 112 supports the tub 106 to suspend from the housing 104 while performing a damping function.

In the upright washing machine configured as above, it is inconvenient to take out the laundry from the upper part of the washing machine with the cover opened. In washing the laundry consisting of different kinds of textures, the laundry should be sorted according to the textures. So, the washing machine should be operated at least two times thereby extending washing time and increasing the amount of used water. The laundry is taken out from the upper part thereby restricting utilization of the upper part so that selection of installation space is limited due to difficult space utilization.

Therefore, to improve the problems of the upright washing machine, necessity has been prominent for a drawer-type washing machine in which a housing is opened to a side, a washing bath is opened/closed in the open side of the housing and the sorted laundry can be washed at the same time.

However, since the cabinets accommodating the washing baths are manually drawn out as described hereinbefore, inconvenience is incurred in putting a large amount of the laundry or repeatedly putting the laundry. Also, since the number of cabinets are opened and closed in the side of the housing, the washing machine may fall down when all of the cabinets are drawn out biasing the center of gravity forward.

SUMMARY OF THE INVENTION

The present invention is proposed to solve the foregoing problems of the related art, and it is therefore an object of the invention to provide a washing machine having a cabinet provided with a washing bath, in which the cabinet can be automatically drawn out.

It is another object of the invention to provide a drawer-type washing machine having a housing partitioned into a plurality of compartments and a locking method thereof, by which it is prevented that the washing machine is biased forward and falls down as all of the cabinets are drawn out.

According to an embodiment of the invention to obtain the object, it is provided a drawer-type washing machine comprising: a housing having one open side; a cabinet which can be drawn out forward through the open side of the housing, the cabinet being positioned within the housing; a washing bath positioned within the cabinet for washing the laundry; and drawing means provided between the housing and the cabinet for automatically drawing out the cabinet.

Here, the drawing means comprises: guide panels provided in a side of the cabinet for guiding the cabinet to be drawn out forward; a driving roller provided within the housing, the driving roller being rotational in the guide panel while contacting therewith; and a driving motor for rotating the driving roller to shift the cabinet forward and backward.

Also, in the drawer-type washing machine of the invention where the housing is partitioned into a plurality of compartments and a cabinet for accommodating the washing bath is positioned in each of the compartments; locking means are provided between the housing and the cabinets for restraining the cabinet from being drawn out forward from the housing.

Here, the locking means comprises: solenoids having actuating rods for linearly moving upon being powered, each of the solenoids being provided within each of the compartments for receiving each of the cabinets; and fitting members for performing a fitting functions upon movement of the actuating rods, each of the fitting members being provided in each of the cabinets.

According to another embodiment of the invention to solve the object, it is provided a locking method of a drawer-type washing machine comprising the following steps of: judging if a first cabinet is opened when the washing machine is powered on; if the first cabinet is judged as opened, powering a second locking means to locking a second cabinet; if the first cabinet is judged as closed, judging if a second cabinet is opened; and if the second cabinet is judged as opened, powering the first locking means to lock the first cabinet.

DETAILED DESCRIPTION OF THE PREFERRED EMBODIMENT

Hereinafter it will be described in detail about a drawer-type washing machine and a locking method thereof according to embodiments of the invention in reference to the appended drawings.

Figure 1:
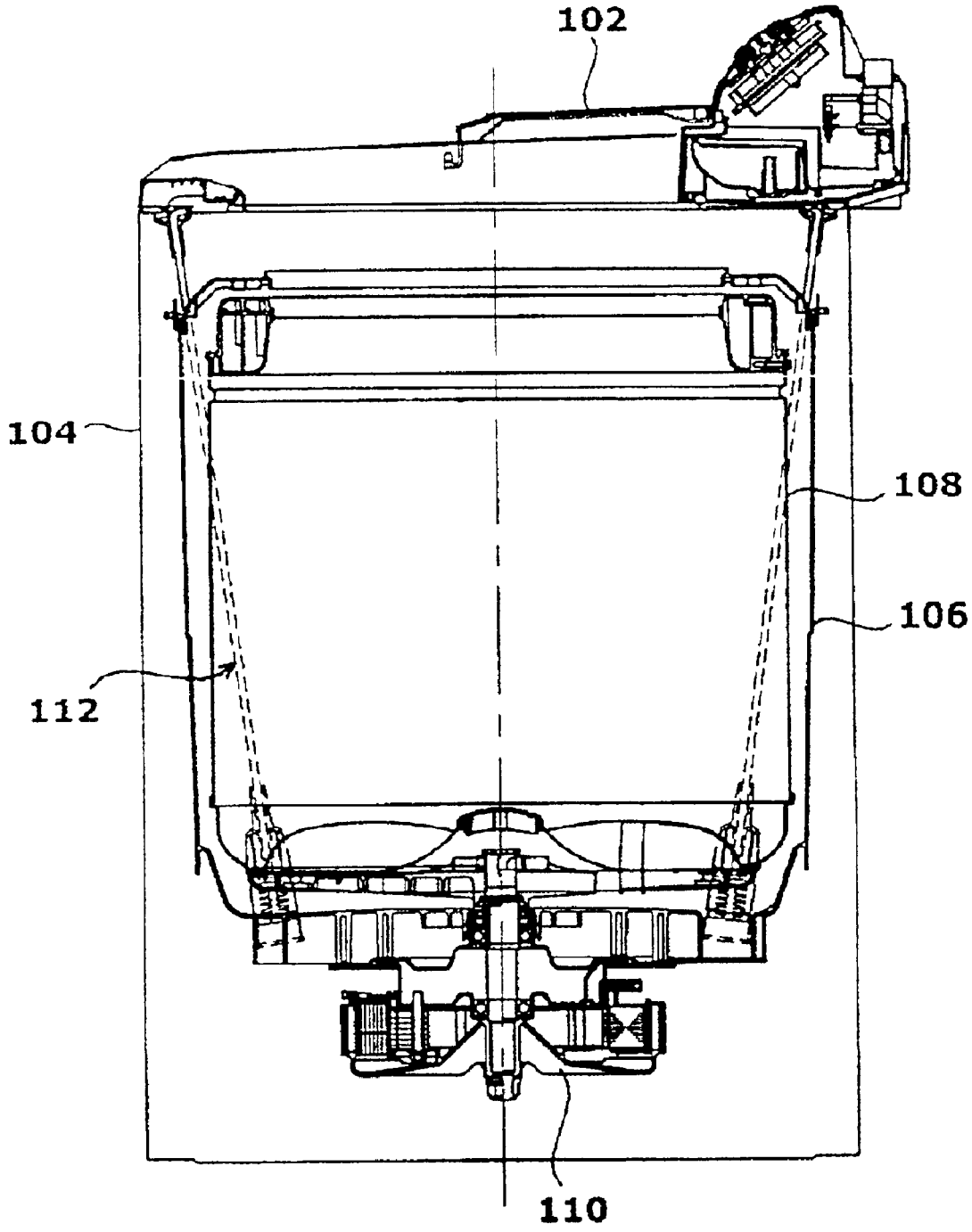
FIG.1(Prior Art)
FIG. 1 is a longitudinal sectional view of an upright washing machine of the related art.
Figure 2:
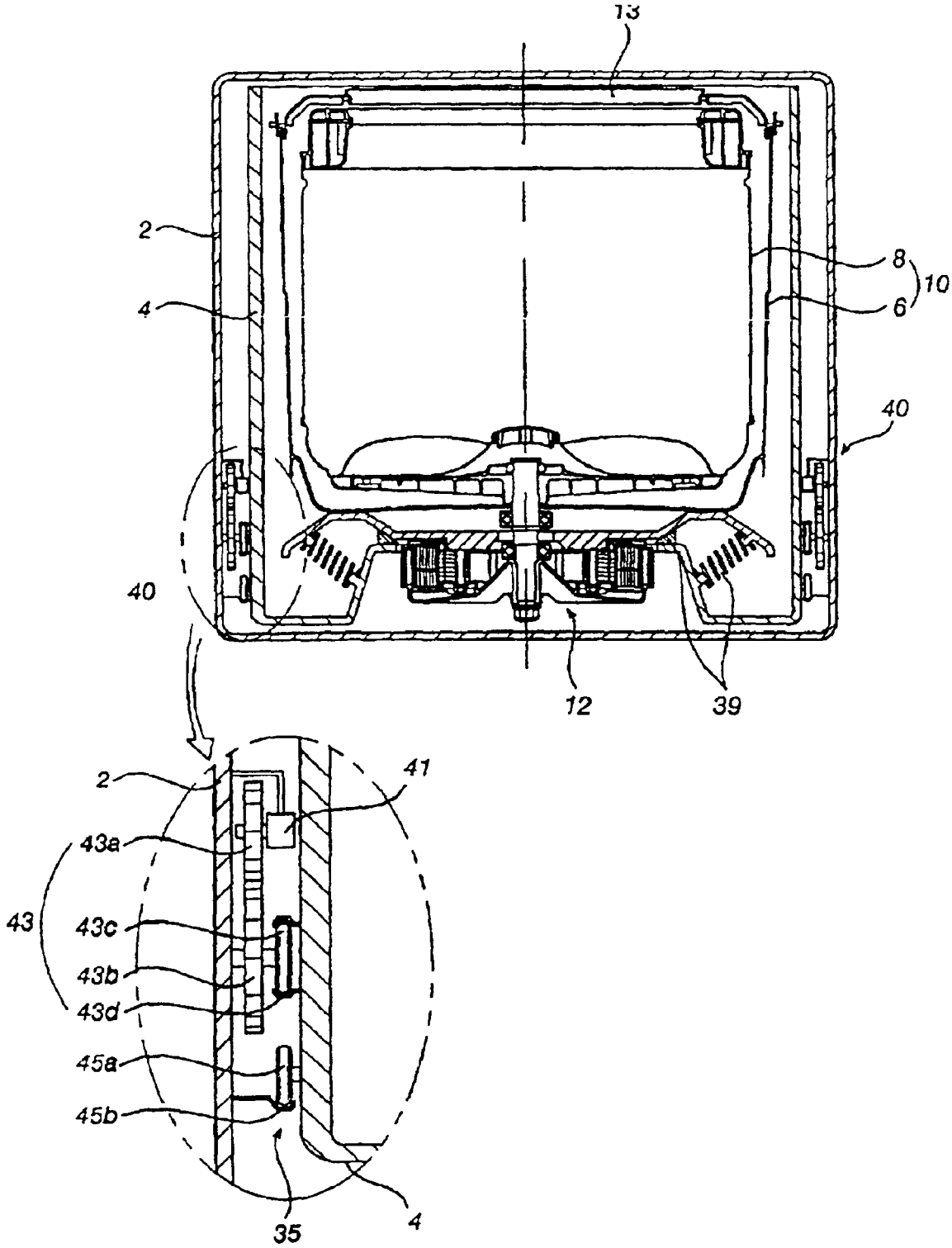
FIG. 2 is a front sectional view of a drawer-type washing machine for showing a magnified drawing means thereof according to the first embodiment of the invention.
Figure 3:
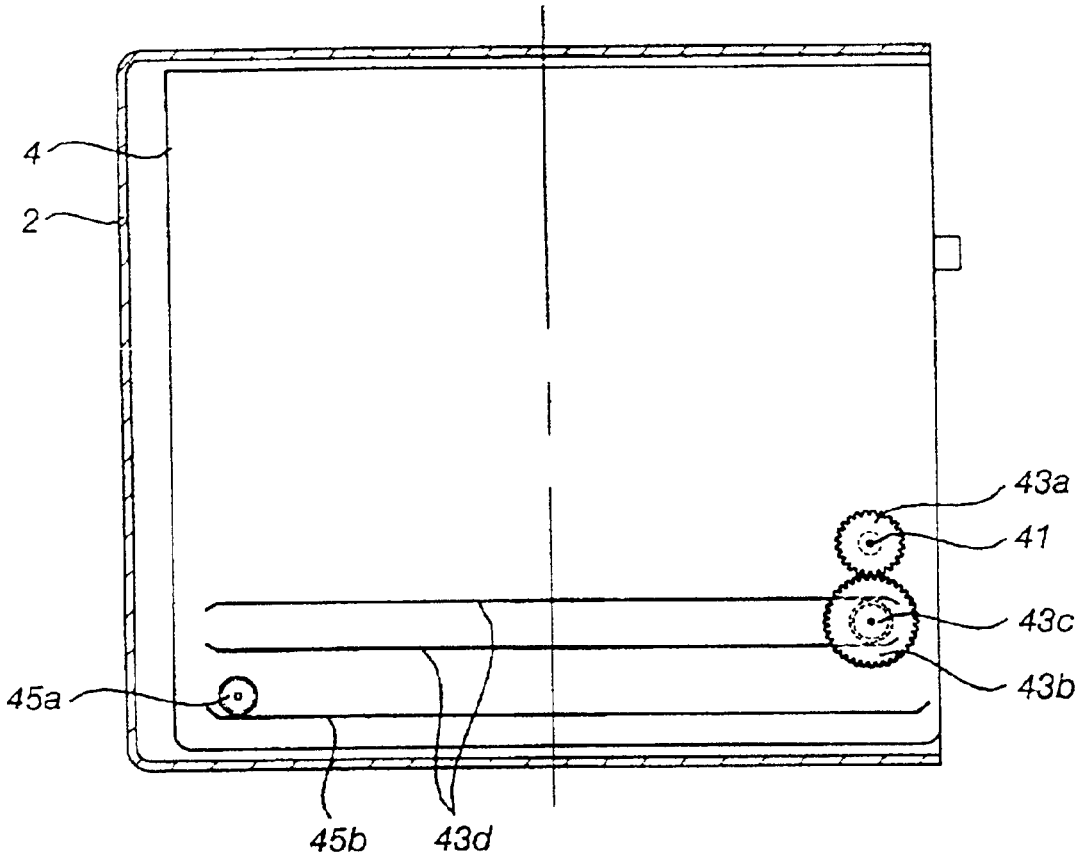
FIG. 3 is a schematic side view of the drawer-type washing machine for showing the drawing means thereof according to the first embodiment of the invention.
Figure 4:
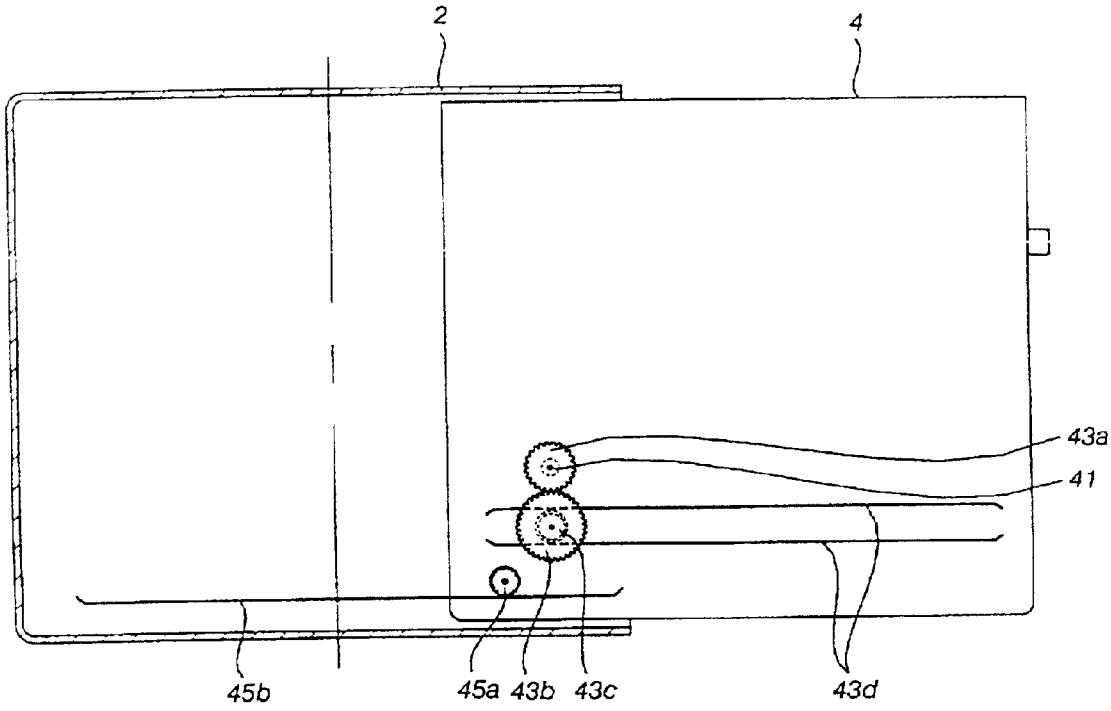
FIG. 4 is a schematic side view of the drawer-type washing machine for showing the drawing means thereof in which a washing bath of the washing machine is opened according to the first embodiment of the invention.
Figure 5:
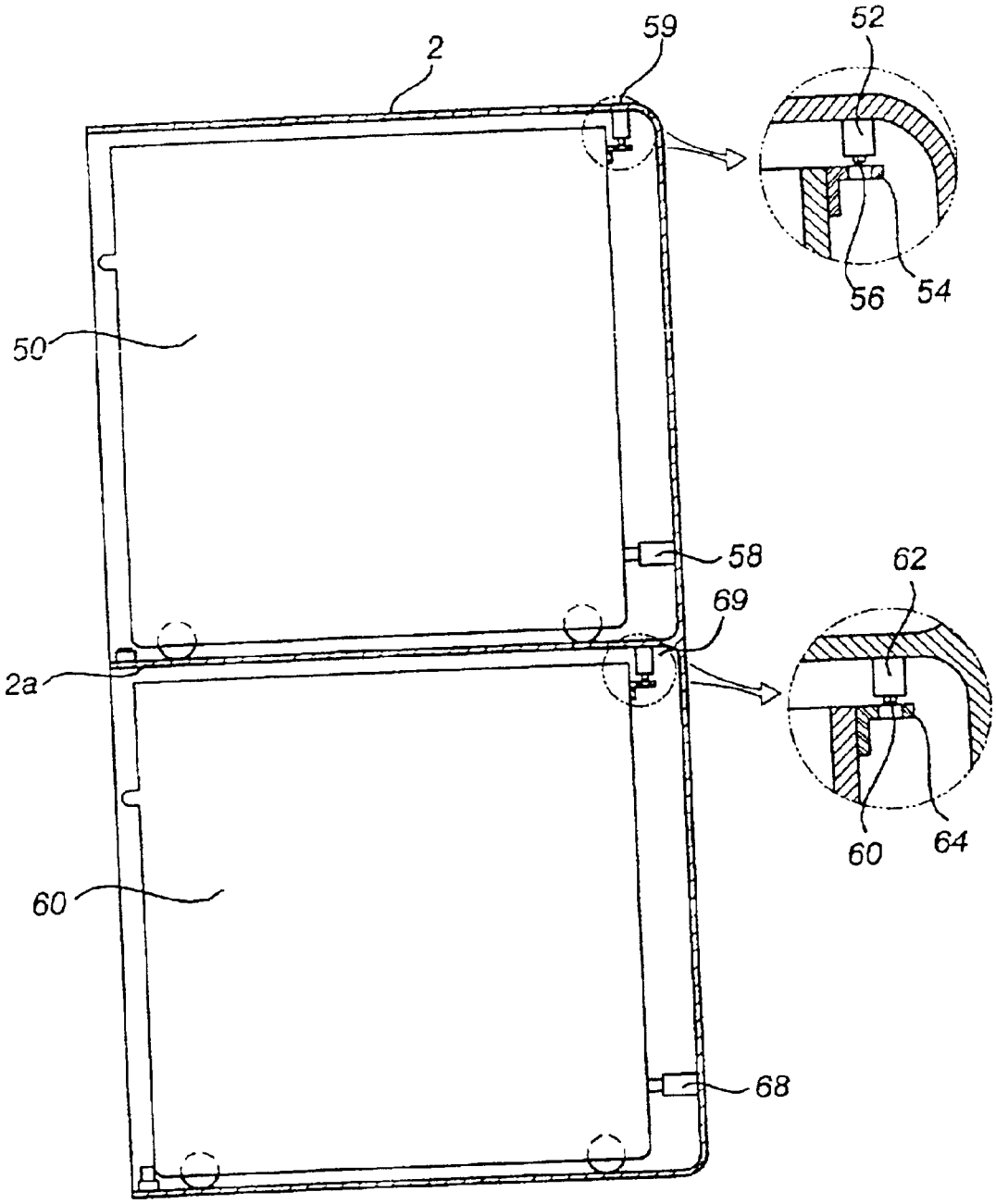
FIG. 5 is a schematic side view of a drawer-type washing machine for showing a locking means thereof according to the second embodiment of the invention.
Figure 6:
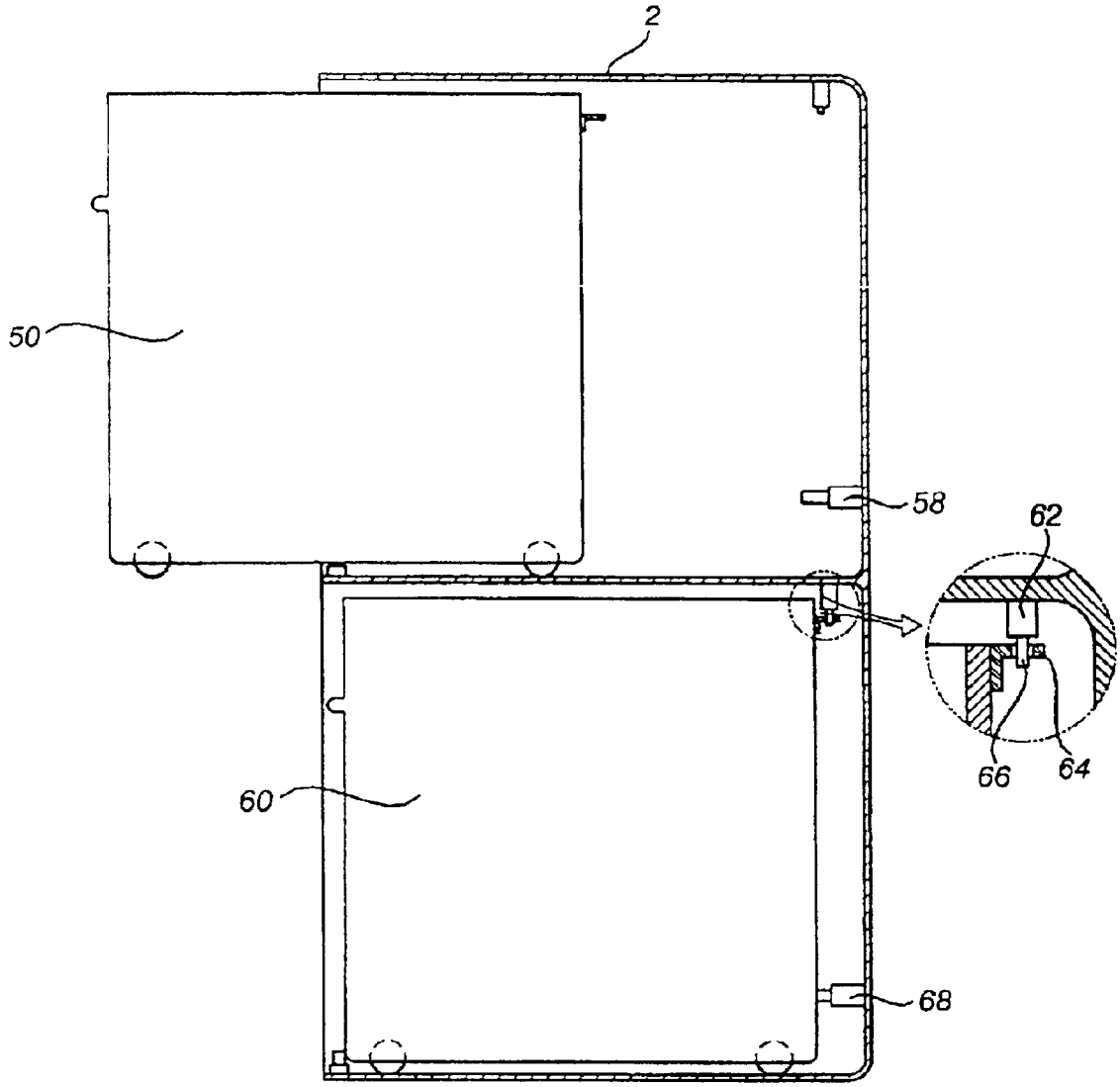
FIG. 6 is a schematic side view of the drawer-type washing machine for showing the locking means thereof in which a washing bath of the washing machine is opened according to the second embodiment of the invention.
Figure 7:
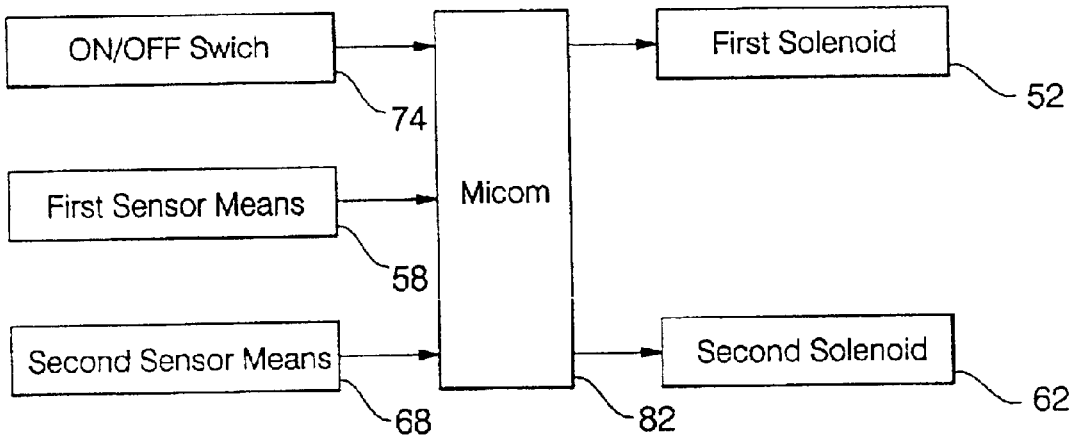
FIG. 7 is a block diagram for showing the locking means of the drawer-type washing machine according to the second embodiment of the invention.
Figure 8:
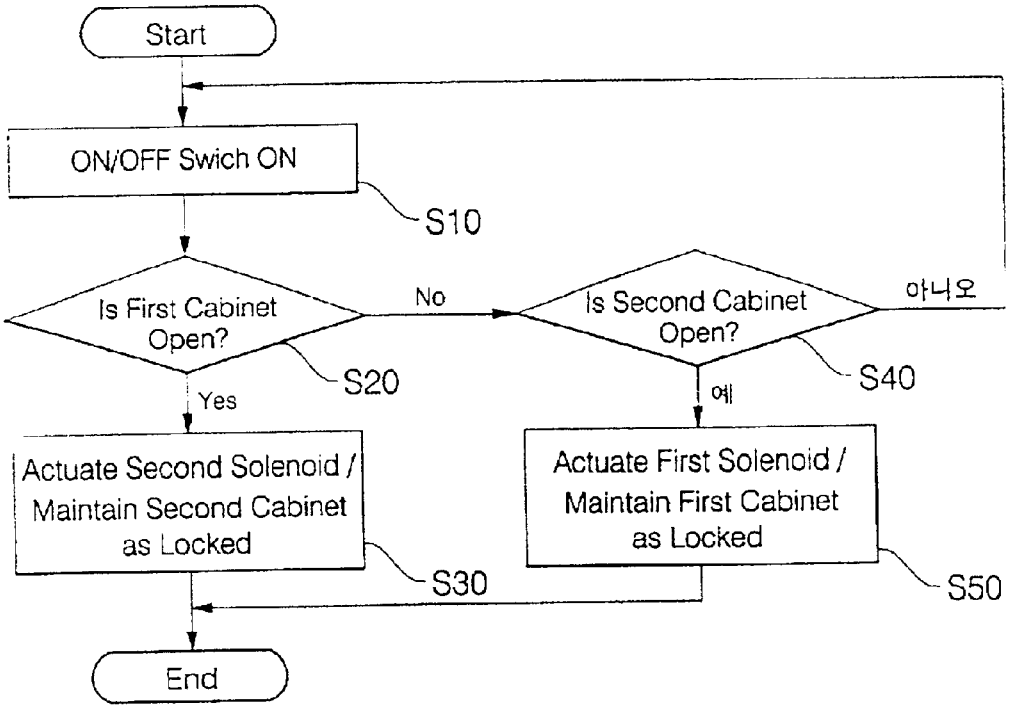
FIG. 8 is a flow chart for showing a locking method of the drawer-type washing machine according to the second embodiment of the invention.

As shown in FIG. 2 to FIG. 4, in the drawer-type washing machine according to the first embodiment of the invention, a housing 2 defines an outer contour and has one open side, a cabinet 4 is inserted both slidingly and movably into the housing 2 with the open upper side, a washing bath 10 has a tub 6 installed within said cabinet 4 for containing washing water and a basket 8 installed within the tub 6 for doubling as a washing basket and a drier basket, a driving unit 12 is installed in the lower part of the tub 6 for rotating the basket 8, a damping unit 39 is installed between the lower part of the tub 6 and the inner side of the cabinet 4 and supports the washing bath 10 while functioning as a damper, and drawing means 40 are installed between the housing 4 and the cabinet 2 so that the cabinet 4 can be automatically drawn out with only a switch manipulation.

Referring to FIG. 3, the drawing means 40 (only one is shown) includes guide panels 43*d* elongated in the horizontal direction at one side of both outer side walls of the cabinet 4 for allowing the cabinet 4 to move linearly, a driving roller 43*c* rotationally installed within the guide panels 43*d* and a driving motor 41 for rotating the driving roller 43*c* to shift the cabinet 4 forward and backward.

The guide panels 43*d* are composed of upper and lower rails which contact with the driving roller 43*c* respectively and attached horizontally in length to one outer side wall of the cabinet 4.

The driving roller 43*c* is made of an elastic material so that the cabinet 4 can be slid due to friction force produced from contact with the guide panels 43*d*. Also, as an effect of the elastic material, vibration which is produced in driving the cabinet 4 may not be transmitted to the housing 2.

In FIG. 3, a driving gear 43*a* is installed in an axis connected with the driving motor 41 installed in one side of the housing 2, and a driven gear 43*b* is installed in an axis of the driving roller 43*c* for engaging into the driving gear 43*a*.

The driven gear 43*b* is meshed into the driving gear 43*a* with a diameter larger compared to the driving gear 43*a* so that rotational force from the driving gear 43*a* is transmitted to the driving roller 43*c* as more increased while rotational speed thereof is transmitted to the driving roller 43*c* as decreased.

As shown in FIG. 3, the housing 2 is provided with guide rails 45*b* (only one is shown), and support rollers 45*a* (only one is shown also) positioned on the guide rail 45*b* is rotationally installed in one side of the cabinet 2.

The support rollers 45*a* are installed in the front and rear at both sides of the cabinet 4 together with the driving rollers 43*c* to enable the cabinet 4 to be stably drawn out while maintaining balance, and made of an elastic material as the driving rollers 43*c* to function as a damper so that vibration may not transmitted to the housing 2 in driving the washing machine.

The operation of the drawing means in the drawer-type washing machine having the foregoing configuration according to the first embodiment of the invention will be described as follows:

First, when a user manipulates a switch, the driving motor 41 is actuated accompanying actuation of the driving motor 43*a* installed in the rotation axis thereof, the driven gear 43*b* engaged into the driving gear 43*a* is amplified in rotation force due to relatively larger diameter and more gear teeth, and then high rotation speed of the driving motor is decelerated in transmission to the driving roller 43*c* for stably drawing out the cabinet 4.

Also, when the driving roller 43*c* is actuated, the cabinet 4 is linearly moved due to friction force produced between the driving roller 43*c* and the guide panels 43*d* to complete opening of the cabinet 4.

Then, when the cabinet 4 is closed after receiving the laundry into the washing bath 10, the same process is carried out as in opening the cabinet 4.

A drawer-type washing machine and a locking method thereof according to the third embodiment of the invention are shown in FIG. 5 to FIG. 8. In the drawer-type washing machine, a housing 2 has one open side and a partition 2*a* for dividing the inner space into upper and lower compartments, upper and lower cabinets 50 and 60 are installed in the upper and lower compartments of the housing 2 respectively and can be drawn out forward through the open side of the housing 2, and a locking means is installed between the housing 2 and the first and second cabinets 50 and 60 for preventing both of the first and second cabinets 50 and 60 from being drawn out forward from the housing 2.

Each of the cabinets 50 and 60 accommodates a washing bath within the same for washing the laundry as in the foregoing first embodiment.

The locking means comprises a first locking means 59 installed in the rear side of the inner upper wall of the housing 2 for performing a locking function to the first cabinet 50, a second locking means 69 installed in the rear side of the lower surface of the partition 2*a* for performing a locking function to the second cabinet 60, and a control means, if one of the first and second cabinets 50 and 60 is opened, for actuating the locking means 59 or 69 installed in the other one of the cabinets 50 and 60 to prevent both of the first and second cabinets 50 and 60 from being drawing out.

The first locking means 59 has a first solenoid 52 attached to the rear side of the inner upper wall of the housing 2 where the first cabinet 50 is inserted and having an actuating rod 56 which vertically moves upon being powered, and a first fitting member 54 installed in the rear upper surface of the first cabinet 50 for performing a fitting function to retain the first cabinet 50 from a further movement when the actuating rod 56 moves downward. The second locking means 69 has a second solenoid 62 attached to the lower rear side of the compartment 2*a* and having an actuating rod 66 which vertically moves upon being powered, and a second fitting member installed in the rear upper surface of the second cabinet 60 for performing a fitting function to retain the second cabinet 60 from a further movement when the actuating rod 66 moves downward.

The control means has an opening/closing switch 74 manipulated by the user to draw out the first and second cabinets 50 and 60, a first sensor means 58 installed in the inner rear side of the first cabinet receiving compartment of the housing 2 for detecting if the cabinet 50 is drawn out, a second sensor means 68 installed in the inner rear side of the second cabinet receiving compartment of the housing 2 for detecting if the second cabinet 60 is drawn out, and a micom 82 for selectively operating the first and second solenoids 52 and 62 in response to electric signals applied from the first and second sensor means 58 and 68.

Here, the first and second sensor means 58 and 68 are composed of limit switches. The limit switches are pressed by the rear sides of the cabinets to be off when the first and second cabinets 50 and 60 are closed, and return to be on when the first and second cabinets 50 and 60 are opened.

The locking method of the drawer-type washing machine according to the second embodiment of the invention having the foregoing configuration will be described in detail as follows:

The opening/closing switch 74 of the washing machine is manipulated so that the first cabinet 50 or the second cabinet is drawn out forward in step S10, it is judged if the cabinet is opened in step S20. In other words the micom 82 confirms the first sensor menas 58 outputs an on signal or an off signal.

If the cabinet 50 is judged as opened in step S20, the second solenoid 62 is powered to lock the second cabinet 60 in step S30. In other words, when the on signal is applied from the first sensor means 58 to the micom 82 so that the micom 82 judges the first cabinet 50 as opened and applies power to the second solenoid 62, the second actuating rod 66 moves downward fitting into the second fitting member 64 to lock the second cabinet 60.

Here, if the first cabinet 50 is judged as closed, it is judged if the second cabinet 60 is opened in step S40. In other words, the micom 82 judges if a signal from the second sensor means 68 is the on signal or the off signal to confirm if the second cabinet 60 is opened.

If the second cabinet 60 is judged as opened in step S40, the first solenoid 52 is powered to lock the first cabinet 50 in step S50. In other words, when the off signal is applied from the first sensor means 58 and the on signal is applied from the second sensor means 68, the micom 82 judges the second cabinet 60 as opened to apply power to the first solenoid 52. Then, the first actuating rod 56 moves downward fitting into the first fitting member 54 attached to the first cabinet 50 to lock the first cabinet 50.

According to the drawer-type washing machine and the locking method thereof of the invention having the foregoing configuration, the cabinet is automatically drawn out only if the switch installed in the outer wall of the housing is manipulated. Also, in the housing partitioned into a plurality of compartments, upon judging at least one cabinet as opened, the remaining cabinet is locked to prevent the washing machine from falling down as the plurality of cabinets are drawn out at the same time forwardly biasing the center of gravity.

What is claimed is:

1. A laundry washing machine comprising:

a housing having one open side;

a drawer which can be drawn out forward through the open side of said housing, said drawer being positioned within said housing;

a washing bath positioned within said drawer for washing the laundry; and a rotating driving motor provided between said housing and said drawer for automatically shifting said drawer into and out of said housing.

2. A laundry washing machine according to claim 1, further comprising:

guide panels provided in a side of said drawer for guiding said drawer to be drawn out forward; and a driving roller provided within said housing, said driving roller being rotational in said guide panel while contacting therewith, wherein said driving motor rotates said driving roller to shift said drawer forward and backward.

3. A drawer-type washing machine comprising:

a housing having one open side;

a cabinet which can be drawn out forward through the open side of said housing, said cabinet being positioned within said housing;

a washing bath positioned within said cabinet for washing the laundry; and drawing means provided between said housing and said cabinet for automatically drawing out said cabinet, wherein said drawing means comprises:

guide panels provided in a side of said cabinet for guiding said cabinet to be drawn out forward;

a driving roller provided within said housing, said driving roller being rotational in said guide panel while contacting therewith; and a driving motor for rotating said driving roller to shift said cabinet forward and backward.

4. A drawer-type washing machine according to claim 3, wherein said drawing means further comprises a driving gear installed in an axis of said driving motor and a driven gear installed in an axis of said driving roller for engaging into said driving gear.

5. A drawer-type washing machine according to claim 3, wherein said driving roller is made of an elastic material.

6. A drawer-type washing machine according to claim 3, wherein said guide panel has upper and lower rails, each of said rails contacting with said driving roller.

7. A drawer-type washing machine according to claim 3, further comprising a guide rail within said housing and a support roller attached to said cabinet, said support roller being rotational on said guide rail.

8. A laundry washing machine comprising:

a housing having one open side and partitioned into a plurality of compartments;

a plurality of drawers which can be drawn out forward through the open side of said housing, each of said drawers being positioned in each of said compartments;

washing baths for washing the laundry, each of said washing baths being positioned within each of said drawers; and locking devices provided between said housing and said drawers for preventing one of said drawers from being drawn out forward from said housing when another of said drawers is located outwardly of said housing.

9. A laundry washing machine according to claim 8, wherein said locking devices comprise:

solenoids having actuating rods for linearly moving upon being powered, each of said solenoids being provided within each of said compartments for receiving each of said drawers; and fitting members for performing a fitting functions upon movement of said actuating rods, each of said fitting members being provided in each of said drawers.

10. A drawer-type washing machine comprising:

a housing having one open side and partitioned into a plurality of compartments;

cabinets which can be drawn out forward through the open side of said housing, each of said cabinets being positioned in each of said compartments;

washing baths for washing the laundry, each of said washing baths being positioned within each of said cabinets; and locking means provided between said housing and said cabinets for restraining said cabinet from being drawn out forward from said housing, wherein said locking means comprises:

solenoids having actuating rods for linearly moving upon being powered, each of said solenoids being provided within each of said compartments for receiving each of said cabinets; and fitting members for performing a fitting functions upon movement of said actuating rods, each of said fitting members being provided in each of said cabinets.

11. A drawer-type washing machine according to claim 10, wherein said locking means further comprises control means, if at least one of said cabinets is opened, for actuating said locking means in the others of said cabinets from being opened.

12. A drawer-type washing machine according to claim 11, wherein said control means comprises:

sensors provided in said housing for detecting open/closed positions of said cabinets; and a micom for actuating said locking means in response to signals applied from said sensors.

13. A drawer-type washing machine according to claim 12, wherein said sensors are composed of limit switches, in which each of said limit switches is pressed by the side of one of said cabinets to apply an off signal in the closed position of said one of cabinets, and returns to apply an on signal in the open position of said one of cabinets.

* * * * *